US005802189A

United States Patent [19]

Blodget

[11] Patent Number: 5,802,189

[45] Date of Patent: Sep. 1, 1998

[54] SUBWOOFER SPEAKER SYSTEM

[75] Inventor: Clifford L. Blodget, Sugarland, Tex.

[73] Assignee: Samick Music Corporation, Industry, Calif.

[21] Appl. No.: 581,706

[22] Filed: Dec. 29, 1995

[51] Int. Cl.[6] ..... H04R 25/00

[52] U.S. Cl. ..... 381/162; 310/27; 310/154; 310/264; 381/201; 381/199

[58] Field of Search ..... 381/165, 162, 381/200, 201, 199, 192, 91; 310/27, 154, 264

[56] References Cited

U.S. PATENT DOCUMENTS

| | | | |
|---|---|---|---|
| 1,533,757 | 4/1925 | Rahbek et al. | 381/162 |
| 1,580,517 | 4/1926 | Marbury | 381/192 |
| 1,683,946 | 9/1928 | Baldwin | 381/162 |
| 1,702,935 | 2/1929 | Edison | 381/162 |
| 1,866,565 | 7/1932 | Holst et al. | 381/200 |
| 1,946,098 | 2/1934 | Morrison | 381/200 |
| 2,644,427 | 7/1953 | Sedgfield | 381/162 |
| 2,661,825 | 12/1953 | Winslow | 381/162 |
| 2,864,898 | 12/1958 | Gunther | 381/199 |
| 3,970,804 | 7/1976 | O'Brien | 381/162 |
| 4,564,727 | 1/1986 | Danley et al. | 381/162 |
| 5,337,030 | 8/1994 | Mohler | 310/154 |

FOREIGN PATENT DOCUMENTS

| | | | |
|---|---|---|---|
| WO 94/19914 | 9/1994 | WIPO | 381/165 |

*Primary Examiner*—Curtis A. Kuntz
*Assistant Examiner*—Rexford N. Barnie
*Attorney, Agent, or Firm*—Wendy K. Buskop; Chamberlain, Hrdlicka et al.

[57] ABSTRACT

The present invention provides for an electromechanical transducer for producing sound in response to an audio signal. The transducer has a generally rectangular enclosure, a diaphragm, a cylinder, a drive shaft, a lever means, and a motor means. The diaphragm is associated with the cylinder. The outer diameter of the diaphragm is substantially similar to the inside diameter of the cylinder. The diaphragm is slidably associated with the cylinder. The motor has the characteristic of rotating in response to the application of electric current from an audio source. The characteristic of rotating is limited to an arc having an angle of less than 180 degrees. Thus the motor can make only fractional rotations upon the application of electric current. A method for producing sound in response to an audio signal is also provided.

29 Claims, 4 Drawing Sheets

SUBWOOFER SPEAKER SYSTEM

BACKGROUND OF THE INVENTION

The present invention relates to a new loudspeaker design for producing low frequency audio sound without using a voice coil.

Most conventional loudspeaker systems use a cone type diaphragm driven by a movable voice coil suspended between the pole pieces of a permanent magnet. Electrical energy conveyed to the voice coil causes the coil to reciprocate in a linear path and move the diaphragm. This type of speaker is commonly known as the permanent magnet dynamic type and generally has an efficiency of less than 5 percent.

The acoustic output of a loudspeaker is a function of diaphragm size and diaphragm displacement; other variables include electromagnetic conversion efficiency, rigidity of the diaphragm, and the acoustic impedance and capacitance of the air to vibration at various frequencies. Attempts to produce greater levels of acoustic output and deeper bass reproduction have been directed towards increasing the diameter of the diaphragm, increasing the length of voice coil windings, or otherwise increasing the excursion of the diaphragm. The diameter of the diaphragm is limited by the physical size requirements of the enclosure. Increasing the excursion of the diaphragm is limited by the voice coil design. If the voice coil is too long then the gap has to be larger to keep the coil from contacting the sides of the pole pieces. This in turn weakens the magnetic circuit, reducing efficiency. The only way to compensate for the weakened circuit is to use larger magnets, which would make the speaker very heavy.

A loudspeaker design that can produce bass and sub bass low frequency audio and have greater power handling capabilities than the currently available technology would be highly desirable. An embodiment of the present invention produces bass and sub bass low frequency audio in the range of about 3 to 200 Hz. The current invention may have available power handling of greater than 5,000 watts.

A commercially available state of the art 18 inch low frequency transducer has a diaphragm surface area of approximately 200 square inches and a maximum excursion of approximately one inch yielding a maximum acoustic output of 1.3 watts at 25 Hz or 5.2 watts at 50 Hz. One embodiment of the present invention has a diaphragm surface area of approximately 200 square inches and an excursion of 6 inches yielding an acoustic output of 7.9 watts at 25 Hz or 31.6 watts at 50 Hz. The present invention obviously provides acoustic output unattainable by conventional systems currently available.

A commercially available state of the art 18 inch low frequency transducer typically has an efficiency of less than five percent. This means that for a power input of 900 watts (the typical maximum power handling for a state of the art unit) 570 watts will be dissipated by the voice coil in the form of heat. Any additional power applied to the unit results in thermal failure due to overheating of the voice coil. The thermal resistance of conventional units is typically 1° C./Watt. The claimed invention in contrast can have a thermal resistance of 0.25°C./Watt or less. Provided a conventional unit and the claimed invention both have a maximum operating temperature of 220° C. The conventional unit can dissipate 180 Watts in the form of heat whereas the claimed invention can dissipate 720 Watts in the form of heat.

OBJECTS OF THE INVENTION

It is an object of the present invention to provide an electromechanical transducer without a voice coil that provides high volume output using minimum magnetic gap clearance.

It is another object of the present invention to provide an electromechanical transducer having increased power handling over currently available designs.

It is another object of the present invention to provide an electromechanical transducer with greater excursion than currently available.

It is another object of the present invention to provide a motor means that produces fractional rotations in response to electric current.

It is another object of the present invention to provide a method for producing sound superior to that currently available.

SUMMARY OF THE INVENTION

The present invention provides for an electromechanical transducer for producing sound in response to an audio signal. The transducer has a generally rectangular enclosure, a diaphragm, a cylinder, a drive shaft, a lever means, and a motor means. The enclosure has a longitudinal axis, a first end, a second end, and an inside surface. The first end defines an opening therein. The cylinder has a longitudinal axis, a first end, a second end, and an inside surface defining an inside diameter. The first end is attached to the inside surface of the enclosure adjacent to the opening in the first end of the enclosure. The longitudinal axis of the cylinder is parallel to the longitudinal axis of the enclosure.

The diaphragm is associated with the cylinder. The diaphragm has an apex, a circumferential edge defining an outer diameter and a slidable seal attached to the circumferential edge. The outer diameter of the diaphragm is substantially similar to the inside diameter of the cylinder. The seal keeps air from moving behind the diaphragm while allowing the diaphragm to move in a direction parallel to the longitudinal axis of the cylinder. The diaphragm is slidably associated with the cylinder.

A substantially linear drive shaft connects the diaphragm to a lever. The drive shaft has a first end and a second end, the first end being connected to the apex of the diaphragm. The lever means has a lower end and an upper end. The upper end of the lever is rotatably attached to the second end of the drive shaft.

The motor means has an output shaft connected to the lower end of the lever means. The motor has the characteristic of rotating in response to the application of electric current from an audio source. The characteristic of rotating is limited to an arc having an angle of less than 180 degrees. Thus the motor can make only fractional rotations upon the application of electric current.

The diaphragm design using the slidable seal in place of a surround provides increased excursion over any speaker system previously disclosed. The normal excursion on available speakers is about 1 inch. In the present invention, the slidable seal makes it possible for the diaphragm to travel at least 12 inches and the design may be scaled up so that the diaphragm may travel up to 24 inches. Increased excursion increases the amount of air displaced by the diaphragm thus increasing the volume output by the speaker.

The present design is easy to service in the field. The diaphragm can be removed easily because the seal is not permanently fixed. This allows for easy replacement of the diaphragm and easy access to the motor for inspection and/or subsequent repair.

In another embodiment, there is provided a transducer as described above without the cylinder where the diaphragm is attached to the first end of the enclosure. The diaphragm is positioned adjacent to the opening in the first end of the enclosure.

In yet another embodiment of the invention, there is provided a transducer as described above without a cylinder where the diaphragm is attached to the first end of the enclosure and there is no drive shaft provided. The diaphragm is positioned adjacent to the opening in first end of the enclosure. There is a lever means having a lower end and an upper end where the upper end is attached to the apex of the diaphragm. The motor means has an output shaft connected to the lower end of the lever means. The rotor has the characteristic of rotating in response to the application of electric current from an audio source as described above.

In another embodiment of the present invention, there is provided a unique motor means. The motor means has an armature surrounded by a stator. The armature comprises one continuous winding wrapped around a laminated magnetically conductive metal and is capable of becoming an electromagnet upon the application of electric current to the winding. The stator has at least two magnetic poles and is statically magnetically charged with at least one permanent magnet. In this configuration the motor is only capable of rotating a maximum of 180 degrees. This type of motor does not make full rotations as conventional motors do when current is applied to the motor.

In yet another embodiment of the present invention there is provided a second unique motor means. This motor means has a rotor surrounded by a stator. The stator has one continuous winding wrapped around a laminated magnetically conductive metal and is capable of becoming an electromagnet upon the application of electric current to the winding. The rotor has at least two magnetic poles and is statically magnetically charged with at least one permanent magnet. Like the motor described above, this motor configuration is only capable of rotating a maximum of 180 degrees. This type of motor does not make full rotations as conventional motors do when current is applied to the motor.

The rotor design for each motor described above, uses a laminated iron core which allows greater magnetic flux than the conventional voice coil system. No voice coil is used, therefore the magnetic gap can be much smaller than a conventional voice coil configuration. The smaller the gap between the rotor and the stator, the greater the magnetic flux. With a conventional moving coil motor there is the inherent limitation of the size of the coil itself and the space requirement for the coil to move within the magnetic field. Our design eliminates both of these limitations by replacing the voice coil with a magnet or an electromagnet, thus minimizing the amount of clearance required in the magnetic gap between the rotor and the stator and allowing for greater magnetic flux.

The rotor is constructed so that it may be submersed in oil to provide greater heat dissipation. A motor will generate heat as a result of the excess energy that is not converted to mechanical energy as the power is applied to the motor. The motor will eventually burn out because as the power increases, the motor cannot dissipate the heat fast enough, therefore the available power handling is lowered to compensate for the excess heat. The present design can be completely submersed in oil because the shaft can be sealed. Conventional systems with longer excursion and high power using voice coils are not capable of being submersed in oil because there is no way to seal them. The Ferro fluid normally used with voice coils is insufficient because the oil will be blown out of the magnetic gap at high power with long excursions. The presence of oil also increases the damping of the unit, reducing distortion.

In another embodiment of the invention, there is provided a method for producing sound in response to an audio signal. The first step comprises providing an actuating means having the characteristic of a rotation in response to the application of power modulated with an audio signal. The actuating means comprises 2 or more permanent magnetic poles opposed by 2 or more electromagnetic poles. The rotation is limited to an arc having an angle of less than 180 degrees. Then power modulated with an audio signal is applied to said actuating means creating a fluctuating magnetic field. The fluctuating magnetic field opposes an existing permanent magnetic field thereby producing a rotational torque proportional to the power applied. The rotational torque is then transferred to a diaphragm.

DETAILED DESCRIPTION OF THE PREFERRED EMBODIMENTS

The invention relates to a subwoofer speaker system designed to have greater power handling and output capacity. The speaker system has novel bass and subass low frequency audio producing capabilities. The motor means used in the present invention is characterized by fractional rotations of less than 180 degrees. In order to achieve this rotational scope, the motor comprises two or more competing magnetic fields that may be arranged in different ways. In one arrangement, the rotor is electromagnetically charged with a single set of armature windings around a laminated core and the stator consists of a statically charged magnetic circuit having at least two magnetic poles. The magnetic poles can be generated by one or more permanent or electro magnets. In this configuration, the rotor rotates about an axis, z. At the 0 degree point the magnetic field in the rotor and the stator are aligned with each other, meaning the north pole of the stator is aligned with the south pole of the rotor and the south pole of the stator is aligned with the north pole of the rotor. This position is called the lock-up position. When the rotor moves 90 degrees from the 0 degree point, the rotor's magnetic field is considered 90 degrees out of phase with the magnetic field of the stator. The rotor rests at the 90 degree point when no signal is being received from the current source. When an AC signal is applied to the field windings, the rotor oscillates back and forth about the 90 degree point.

Figure 1:
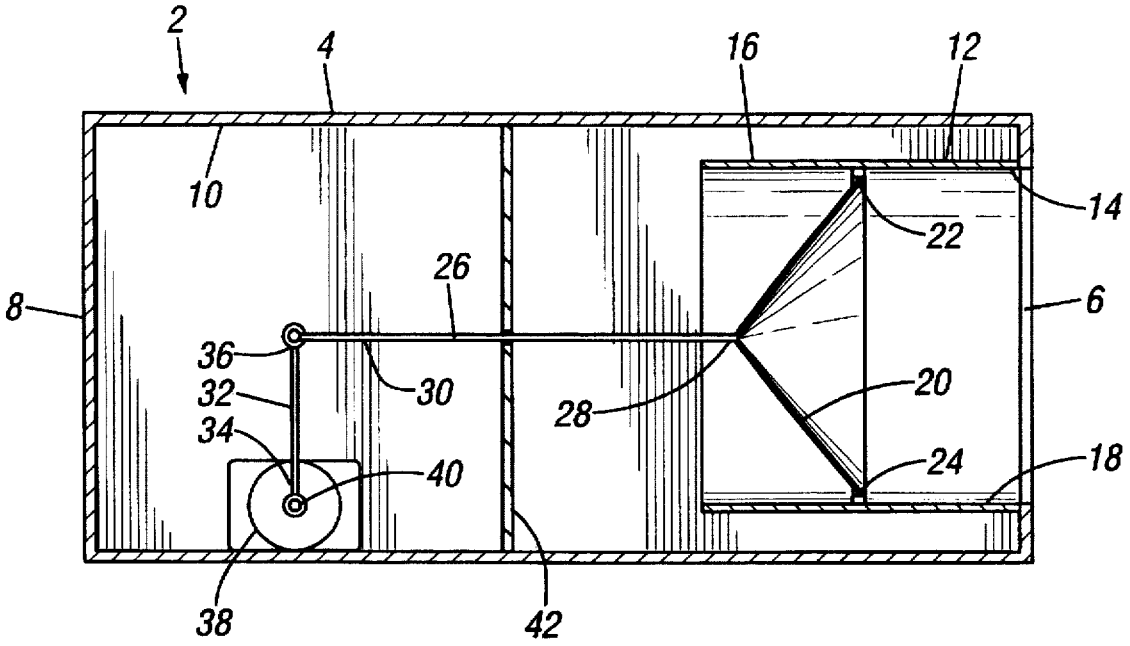
FIG. 1 is a cross-sectional view of the transducer showing the sliding diaphragm embodiment.

In one embodiment of the invention, there is provided an electromechanical transducer 2 for producing sound in response to an audio signal as shown in FIG. 1. The transducer comprises a generally rectangular enclosure 4, a substantially tubular cylinder 12, a diaphragm 20, a drive shaft 26, a lever means 32, and a motor means 38. The enclosure 4 has a longitudinal axis, first end 6, a second end 8, and an inside surface 10. The first end 6 of the enclosure 4 defines an opening.

The substantially tubular cylinder 12 has a longitudinal axis, a first end 14, a second end 16, and an inside surface 18 defining an inside diameter. The first end 14 of the cylinder 12 is attached to the inside surface 10 of the enclosure 4 adjacent to the opening in the first end 6 of the enclosure 4. The longitudinal axis of the cylinder 12 is parallel to the longitudinal axis of the enclosure 4.

The diaphragm 20 has a circumferential edge 22 defining an outer diameter and a slidable seal 24 attached to the circumferential edge 22, the outer diameter is substantially similar to the inside diameter of the cylinder 12. Preferably, the slidable seal 24 is positioned such that the diaphragm 20 displaces air when moved and is capable of moving a distance of between about 0.5 and 24 inches when current is applied to the transducer 2. The slidable seal 24 can be made from felt, plastic, silicone, teflon, organic fiber, glass fiber, graphite fiber, or mixtures thereof Other suitable materials may also be used to make the seal. The seal 24 acts as barrier keeping air from flowing behind the diaphragm 20 while allowing the diaphragm to move extended distances in a direction horizontal to the longitudinal axis of the enclosure 4.

The substantially linear drive shaft 26 has a first end 28 and a second end 30, the first end 28 is connected to the diaphragm 20. Preferably, a means 42 for centering the drive shaft 26 is attached to the drive shaft 26 and the inside surface 10 of the enclosure 4. The means 42 for centering limits the axial deflection of the drive shaft 26 at the time of excursion. The means for centering 42 can be made of an elastic material that has damping properties. The lever means 32 has a lower end 34 and an upper end 36, the upper end 36 is rotatably attached to the second end 30 of the drive shaft 26 by a bearing or a flexible material such as metal, plastic, spring steel, rubber, or other suitable material.

The enclosure 4 can be one of many different designs commercially available. The enclosure 4 can be a sealed box as shown in FIG. 1. The enclosure 4 can also be ported, horn-loaded or have a passive radiator sometimes called a drone cone.

The motor means 38 has an output shaft 40, the output shaft 40 is connected to the lower end 34 of the lever means 32. The motor means 38 has the characteristic of rotating in response to the application of electric current from an audio source. The rotation of the motor means 38 is limited to an arc that has an angle of less than 180 degrees. Preferably, the motor means 38 comprises a rotor 44 surrounded by a stator 46. The rotor can be in several configurations.

Figure 5:
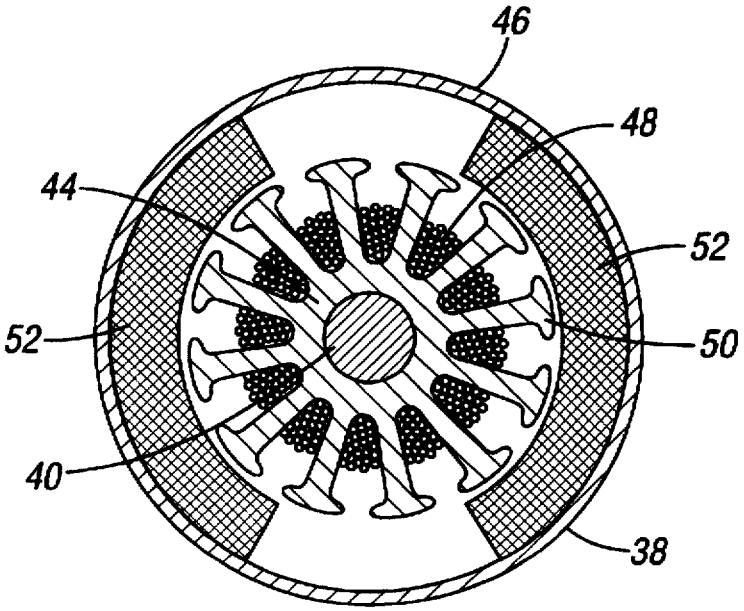
FIG. 5 is a cross-sectional view of one embodiment of the motor means.

In one preferred configuration, the motor means 38 has an armature 44 surrounded by a stator 46 as shown in FIG. 5. The armature comprises one continuous winding 48 wrapped around a laminated magnetically conductive metal 50 and is capable of becoming an electromagnet upon the application of electric current to the winding. The stator has at least two magnetic poles and is statically magnetically charged with at least one permanent magnet 52. Other options such as three, six or eight magnetic poles may also be used. The permanent magnet 52 described above can also be electromagnets.

Figure 4:
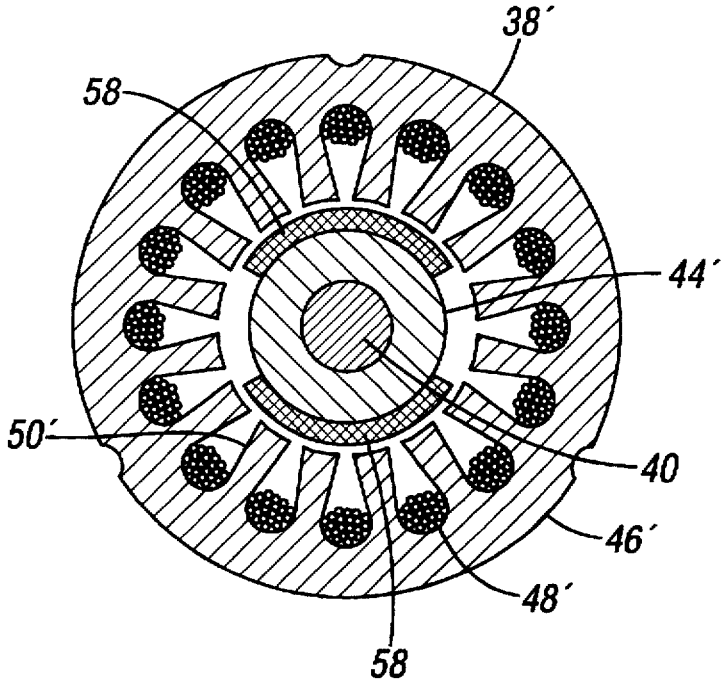
FIG. 4 is a cross-sectional view of one embodiment of the motor means.

In a second preferred configuration, there is a rotor 44' surrounded by a stator 46' as shown in FIG. 4. The stator 46' comprises one continuous winding 48', wrapped around a laminated magnetically conductive metal 50' and is capable of becoming an electromagnet upon the application of electric current to the winding. The rotor 44' has at least two magnetic poles and is statically magnetically charged with at least one permanent magnet 58. Other options such as three, six or eight magnetic poles may also be used. The permanent magnet 58 can also be an electromagnet.

Figure 7:
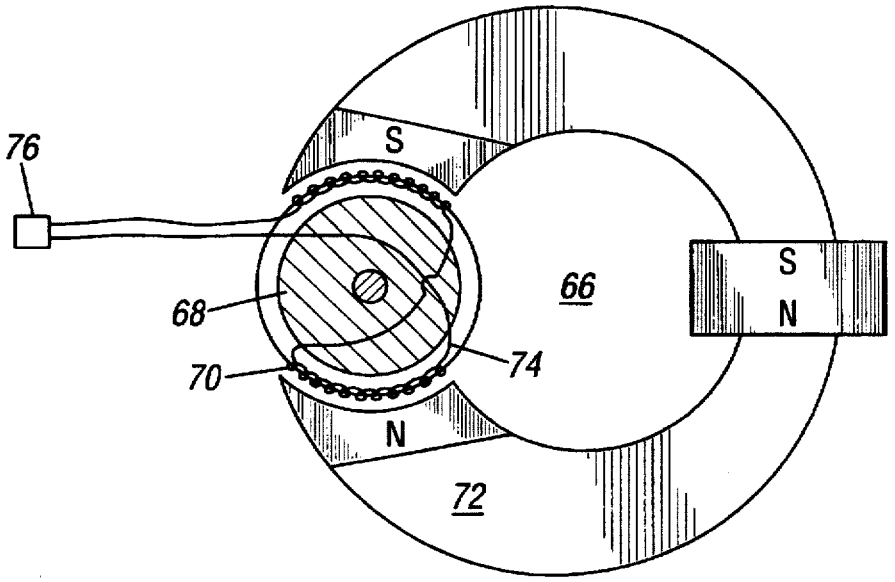
FIG. 7 is a cross-sectional view of the non-commutated moving coil motor means.

In a third preferred configuration, the motor means 38 comprises a non-commutated moving coil motor 66 as shown in FIG. 7. In this configuration, the rotor 68 comprises a coil of wire 70 surrounded by a permanent magnet stator 72 and the permanent magnet stator has at least 2 magnetic poles, preferably 4 poles. The coil of wire 70 is connected to the power source 76 by flexible lead wires 74. The flexible lead wires 74 allow the rotor 68 to rotate freely within an arc having an angle of less than 180 degrees.

In a fourth preferred configuration, the motor means 38 comprises a non-commutated toroidal torque motor. (not shown)

Figure 2:
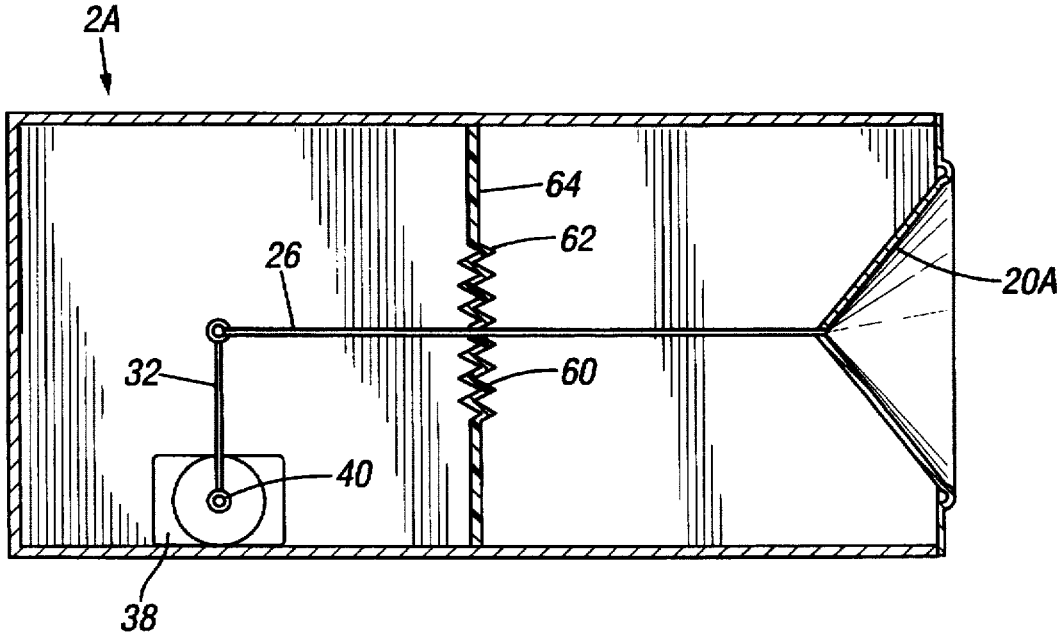
FIG. 2 is a cross-sectional view of the transducer showing the fixed diaphragm embodiment.

Another embodiment of the invention provides an electromechanical-mechanical transducer 2A for producing sound in response to an audio signal with a different diaphragm structure than described previously as shown in FIG. 2. In this embodiment, there is provided an enclosure 4, a drive shaft 26, a lever means 32, and a motor means 38 as described previously. The diaphragm 20A in this embodiment, is attached to the first end of the enclosure 4 adjacent to the opening in the enclosure 4 as shown in FIG. 2. The attachment can be via a conventional surround common in the industry. The limitations on the motor means 38 and the available motor means for driving the lever means 32 are the same as those described above. Preferably, a means for centering 42 the drive shaft is attached to the linear drive shaft 26. The means for centering 42 the drive shaft 26 is a generally cylindrical spider 60 having an outer edge 62. There is a rigid structure 64 attached to the outer edge of the spider 60 and the rigid structure 64 is attached to the enclosure 4. The spider 60 circumferentially surrounds the drive shaft 26.

Figure 3:
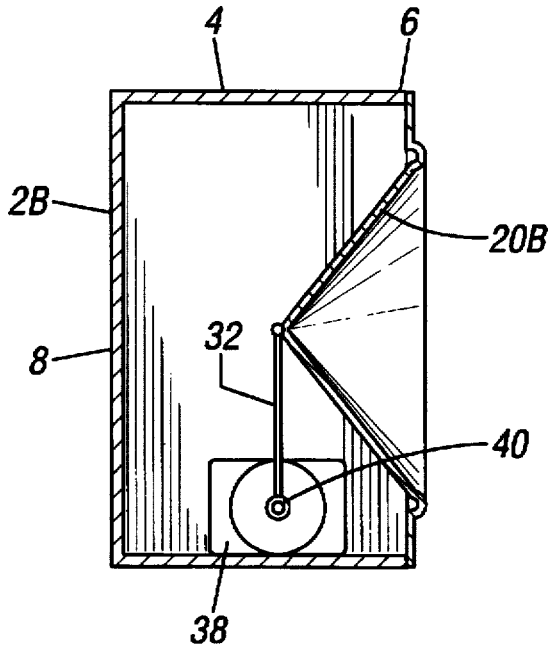
FIG. 3 is a cross-sectional view of the transducer showing the fixed diaphragm embodiment without a drive shaft.

In another embodiment of the present invention, there is provided an electromechanical transducer 2B for producing sound in response to an audio signal as described above with the lever means 32 connected directly to the output shaft 40 of the motor means 38 as shown in FIG. 3. In this embodiment, there is provided an enclosure 4, a lever means 32, and a motor means 38 as described previously. The diaphragm 20B is attached to the opening adjacent the first end 6 of the enclosure 4 as described above as well. The lever means 32 has a lower end and an upper end, the upper end is attached to the diaphragm 20B. The motor means 38 has an output shaft 40 that is connected to the lower end of the lever means 32. The motor means 38 has the characteristic of rotating in response to the application of alternating current from an audio source, the characteristic of rotating is limited to an arc having an angle of less than 180 degrees as described above. This embodiment can also be used with any of the alternate motor means described above.

In another embodiment of the present invention, there is provided a unique motor means 38. The motor means 38 has an armature 44 surrounded by a stator 46 as shown in FIG. 5. The armature 44 comprises one continuous winding wrapped around a laminated magnetically conductive metal 50 and is capable of becoming an electromagnet upon the application of electric current to the winding. The stator 46 has at least two magnetic poles and is statically magnetically charged with at least one permanent magnet 52. In this configuration the motor means 38 is only capable of rotating a maximum of 180 degrees. This type of motor means does not make full rotations as conventional motors do when current is applied to the motor. Alternatively, the stator can have at least 8 magnetic poles. The number of magnetic poles affects the range of rotation for the motor. With two poles the rotor can rotate a maximum of 180 degrees. If four poles are used, the maximum rotation is lowered to 90 degrees. The plurality of permanent magnets can also be electromagnets.

The motor means 38 in the claimed invention having a wound armature 44 and a permanent magnet stator 46 can be constructed using commercially available parts as well. The rotor, stator, end plates, bearings, and other miscellaneous hardware used in permanent magnet DC motors such as Pacific Scientific BA Series motors or Reliance Motion Controls Max 430 Series motors can be used to construct the claimed motor. However, the armature 44 is wound with one winding and two flexible lead wires connect the armature to the power source instead of the brushes and commutators used in conventional motors. Commutation is not needed because the armature 44 in the claimed invention does not make a full revolution. In addition, rare earth magnets are used in the claimed motor as opposed to ceramic magnets used in the conventional motor cited.

In yet another embodiment of the present invention there is provided a second unique motor means 38'. This motor means 38' has a rotor 44' surrounded by a stator 46' as shown in FIG. 4. The stator 46' has one continuous winding 48' wrapped around a laminated magnetically conductive metal 50' and is capable of becoming an electromagnet upon the application of electric current to the winding. The rotor has at least two magnetic poles and is statically magnetically charged with at least one permanent magnet 58. Like the motor described above, this motor configuration is only capable of rotating a maximum of 180 degrees. This type of motor does not make full rotations as conventional motors do when current is applied to the motor.

The number of magnetic poles affect the range of rotation for the motor. With two poles, the rotor can rotate a maximum of 180 degrees. If four poles are used, the maximum rotation is lowered to 90 degrees. Combinations of three, six or even eight poles may also be used with this motor. The plurality of permanent magnet can also be electromagnets.

The motor means 38' in the claimed invention having an permanent magnet rotor 44' surrounded by a laminated wound stator 46' can be constructed using commercially available parts. The rotor, stator, end plates, bearings, and other miscellaneous hardware used in brushless DC servomotors such as Pacific Scientific BR 33 Series motors or Reliance Motion Controls S-Series low inertia brushless servomotors can be used to construct the claimed motor. However, only one of the three phases are used. The claimed motor 38' is wound with one winding 54 as opposed to three.

The non-commutated moving coil motor 66 of the present invention may be constructed in a scaled down version using commercially available parts as shown in FIG. 7. Starting with a Electrocraft or Pacific Scientific moving coil motor, the moving coil rotor is re-wound with one winding having the same number of poles as the permanent magnetic circuit. The winding or coil of wire 70 is connected to the incoming power source 76 using flexible lead wires 74. The stator and brushes of the conventional moving coil motor are not used. This is possible because the claimed motor 66 does not make a full revolution.

The two pole version of the toroidal torque motor, requires no modification. (available from Litton Poly-Scientific).

In another embodiment of the invention, there is provided a method for producing sound in response to an audio signal. The first step comprises providing an actuating means having the characteristic of a rotation in response to the application of power modulated with an audio signal. The actuating means comprises 2 or more permanent magnetic poles opposed by 2 or more electromagnetic poles. The rotation is limited to an arc having an angle of less than 180 degrees. Then power modulated with an audio signal is applied to said actuating means creating a fluctuating magnetic field. The fluctuating magnetic field opposes an existing permanent magnetic field thereby producing a rotational torque proportional to the power applied. The rotational torque is then transferred to a diaphragm.

Figure 6:
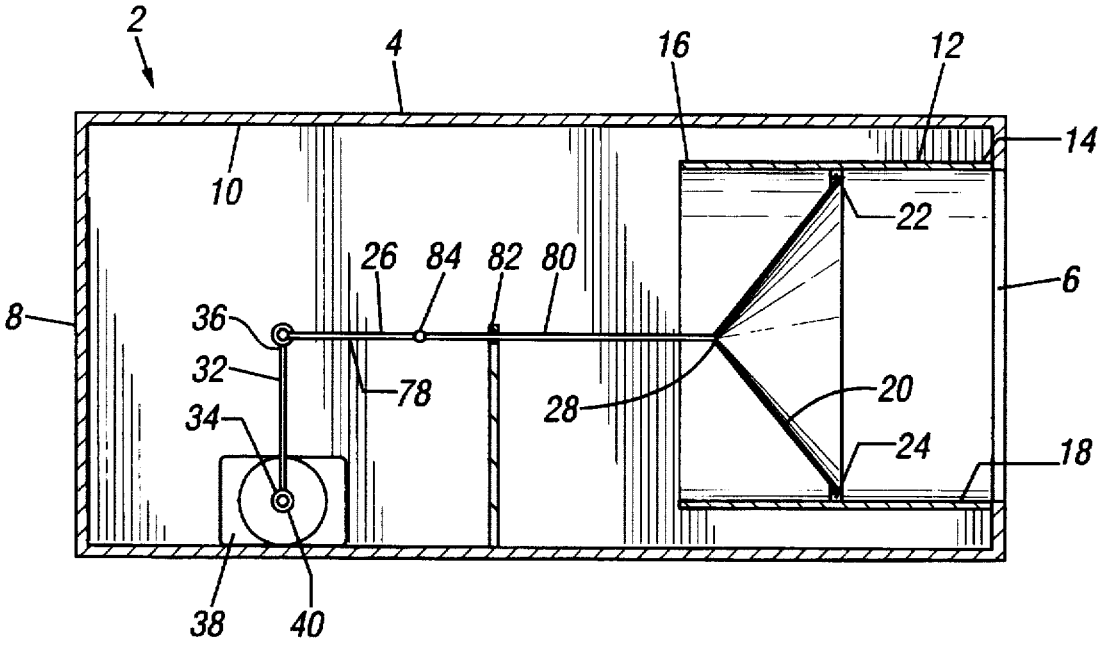
FIG. 6 is a cross-sectional view of the the transducer showing the sliding diaphragm and jointed shaft.

In another alternative embodiment, there is provided a drive shaft 26 having a first portion 78 and a second portion 80 and at least one slide bearing 82 as shown in FIG. 6. The first portion 78 is connected to the second portion 80 by a connection means 84. The first portion 78 is connected to the lever means 32 and the second portion 80 is connected to the diaphragm 20 at the first end of the drive shaft 26. The first portion 78 of the drive shaft 26 comprises a flexible material like plastic, spring steel, or aluminum and the second portion 80 comprises a rigid material. The at least one slide bearing 82 has a first end and a second end. The first end of the slide bearing 82 is slidably associated with the drive shaft 26 and the second end is fixedly attached to the inside surface 10 of the enclosure 4. Preferably, the connection means 84 can be a ball bearing or a flexible material such as plastic or spring steel. This construction allows the drive shaft to bend slightly at the connection means when high power is applied to the motor. The bending action allows the second portion of the drive shaft 26 to remain relatively linear regardless of the level of power applied to the motor.

It can be appreciated that any of the motors described above can drive more than one diaphragm and the structure described herein can be modified to support more than one diaphragm connected to one or more motor means.

What is claimed is:

1. An electromechanical transducer for producing sound in response to an audio signal comprising a generally rectangular enclosure having a longitudinal axis, a first end, a second end, and an inside surface, said first end defining an opening therein;

a substantially tubular cylinder having a longitudinal axis, a first end, a second end, and an inside surface defining an inside diameter, said first end being attached to said inside surface of the enclosure adjacent to said opening in the first end of the enclosure, wherein the longitudinal axis of the cylinder is parallel to the longitudinal axis of the enclosure;

a diaphragm having an apex, a circumferential edge defining an outer diameter and a slidable seal attached to said circumferential edge, said outer diameter being substantially similar to the inside diameter of the cylinder, wherein said diaphragm is slidably associated with the cylinder;

a substantially linear drive shaft having a first end and a second end, said first end being connected to the apex of said diaphragm;

a lever means having a lower end and an upper end, said upper end being rotatably attached to the second end of the drive shaft;

a motor means having an output shaft, said output shaft being connected to the lower end of the lever means, said motor having the characteristic of rotating in response to the application of electric current from an audio source, said characteristic of rotating being limited to an arc having an angle of less than 180 degrees.

2. The electromechanical transducer of claim 1, further comprising means for centering said linear drive shaft.

3. The electromechanical transducer of claim 2, wherein said means for centering the shaft comprises an elastic material having damping properties.

4. The electromechanical transducer of claim 1, wherein the slidable seal is positioned such that the diaphragm displaces air when moved, and said slidable seal moves a distance of between about 0.5 and 24 inches.

5. The electromechanical transducer of claim 1, wherein the slidable seal comprises a material selected from the group consisting of felt, plastic, silicone, teflon, organic fiber, glass fiber, and graphite fiber, and mixtures thereof.

6. The electromechanical transducer of claim 1, wherein the motor means further comprises an armature surrounded by a stator having 2 or more magnetic poles, and said armature comprises one continuous winding wrapped around a laminated magnetically conductive metal, wherein the armature is capable of becoming an electromagnet upon the application of electric current to the winding, and said stator is statically magnetically charged with at least one permanent magnet.

7. The electromechanical transducer of claim 6, wherein the at least one permanent magnet is an electromagnet.

8. The electromechanical transducer of claim 1, wherein said motor means further comprises a rotor having 2 or more magnetic poles and being surrounded by a stator, and said stator comprising one continuous winding wrapped around a laminated magnetically conductive metal wherein said stator is capable of becoming an electromagnet upon the application of electric current to the winding, and said rotor is statically magnetically charged with at least one permanent magnet.

9. The electromechanical transducer of claim 8, wherein the at least one permanent magnet is an electromagnet.

10. The electromechanical transducer of claim 1, wherein said motor means comprises a non-commutated moving coil motor.

11. The electromechanical transducer of claim 10, wherein the motor means further comprises a rotor surrounded by a statically magnetically charged stator, said rotor having a coil of wire wound such that said coil has at least 2 magnetic poles.

12. The electromechanical transducer of claim 1, wherein the motor means comprises a non-commutated toroidal torque motor.

13. An electromechanical transducer for producing sound in response to an audio signal comprising:

a generally rectangular enclosure having a longitudinal axis, a first end, a second end, and an inside surface, said first end defining an opening therein;

a diaphragm attached to said first end of the enclosure, said diaphragm being positioned adjacent to said opening;

a substantially linear drive shaft having a first end and a second end, said first end being connected to said diaphragm;

a lever means having a lower end and an upper end, said upper end being rotatable attached to the second end of the drive shaft;

a motor means having an output shaft, said output shaft being connected to the lower end of the lever means, said motor having the characteristic of rotating in response to the application of electric current from an audio source, said characteristic of rotating being limited to an arc having an angle of less than 180 degrees and said motor means further comprising a non-commutated moving coil motor.

14. An electromechanical transducer for producing sound in response to an audio signal comprising:

a general rectangular enclosure having a longitudinal axis, a first end, a second end, and an inside surface, said first end defining an opening therein;

a diaphragm attached to said first end of the enclosure, said diaphragm being positioned adjacent to said opening;

a substantially linear drive shaft having a first end and a second end, said first end being connected to said diaphragm;

means for centering said drive shaft comprising a generally cylindrical spider having an outer edge, a rigid structure attached to the outer edge of the spider, wherein the rigid structure is attached to the enclosure, said spider circumferentially surrounding the drive shaft;

a lever means having a lower end and an upper end, said upper end being rotatably attached to the second end of the drive shaft; and a motor means having an output shaft, said output shaft being connected to the lower end of the lever means, said motor having the characteristic of rotating in response to the application of electric current from an audio source, said characteristic of rotating being limited to an arc having an angle of less than 180 degrees.

15. The electromechanical transducer of claim 13, wherein the motor means further comprises an armature surrounded by a stator having 2 or more magnetic poles, and said armature comprises one continuous winding wrapped around a laminated magnetically conductive metal, wherein the armature is capable of becoming an electromagnet upon the application of electric current to the winding, and said stator is statically magnetically charged with at least one permanent magnet.

16. The electromechanical transducer of claim 15, wherein the at least one permanent magnet is an electromagnet.

17. The electromechanical transducer of claim 13, wherein said motor means further comprises a rotor having 2 or more magnetic poles and being surrounded by a stator, and said stator comprising one continuous winding wrapped around a laminated magnetically conductive metal wherein said stator is capable of becoming an electromagnet upon the application of electric current to the winding, and said rotor is statically magnetically charged with at least one permanent magnet.

18. The electromechanical transducer of claim 17, wherein the at least one permanent magnet is an electromagnet.

19. An electromechanical transducer for producing sound in response to an audio signal comprising:

a generally rectangular enclosure having a longitudinal axis, a first end, a second end, and an inside surface, said first end defining an opening therein;

a diaphragm attached to said first end of the enclosure, said diaphragm being positioned adjacent to said opening;

a lever means having a lower end and an upper end, said upper end being attached to the apex of the diaphragm;

a motor means having an output shaft, said output shaft being connected to the lower end of the lever means, said motor having the characteristic of rotating in response to the application of electric current form an audio source, said rotation being limited to an arc having an angle of less than 180 degrees and said motor means further comprising a non-commutated moving coil motor.

20. The electromechanical transducer of claim 19, wherein the motor means further comprises an armature surrounded by a stator having 2 or more magnetic poles, and said armature comprises one continuous winding wrapped around a laminated magnetically conductive metal, wherein the armature is capable of becoming an electromagnet upon the application of electric current to the winding, and said stator is statically magnetically charged with at least one permanent magnet.

21. The electromechanical transducer of claim 20, wherein the at least one permanent magnet is an electromagnet.

22. The electromechanical transducer of claim 20, wherein the at least one permanent magnet is an electromagnet.

23. The electromechanical transducer of claim 19, wherein the motor means further comprises a rotor surrounded by a statically magnetically charged stator, said rotor having a coil of wire wound such that said coil has at least 2 magnetic poles.

24. The electromechanical transducer of claim 1, wherein the drive shaft further comprises a first portion connected to a second portion by a connection means, said first portion being connected to said lever means and said second portion being connected to said diaphragm at the first end of the drive shaft; and at least one slide bearing, said at least one slide bearing having a first end and a second end wherein said first end of said at least one slide bearing is slidably associated with the drive shaft and said second end is fixedly attached to the inside surface of the enclosure.

25. The electromechanical transducer of claim 24, wherein the connection means is a ball bearing.

26. The electromechanical transducer of claim 24, wherein the connection means is selected from the group consisting of plastic, spring steel, and aluminum.

27. The electromechanical transducer of claim 24, wherein said first portion of the drive shaft comprises a flexible material and said second portion comprises a rigid material.

28. An electromechanical transducer for producing sound in response to an audio signal comprising:

a general rectangular enclosure having a longitudinal axis, a first end, a second end, and an inside surface, said first end defining an opening therein;

a diaphragm attached to said first end of the enclosure, said diaphragm being positioned adjacent to said opening;

a lever means having a lower end and an upper end, said upper end being attached to the apex of the diaphragm;

a motor means having an output shaft, said output shaft being connected to the lower end of the lever means, said motor having the characteristic of rotating in response to the application of electric current from an audio source, said rotation being limited to an arc having an angle of less than 180 degrees and said motor means further comprises a rotor having 2 or more magnetic poles and being surrounded by a stator, and said stator comprising one continuous winding wrapped around a laminated magnetically conductive metal wherein said stator is capable of becoming an electromagnet upon the application of electric current to the winding, and said rotor is statically magnetically charged with at least on permanent magnet.

29. An electromechanical transducer as set forth in claim 19 wherein said electromechanical transducer includes a linear drive shaft having a first end and a second end and said lever means transducer includes a linear drive shaft having a first end and a second end and said lever means is connected to said diaphragm by said drive shaft which connects at said first end to the lever means and at its second end to the apex of the diaphragm.

* * * * *